United States Patent [19]

Stephenson

[11] Patent Number: 4,598,969

[45] Date of Patent: Jul. 8, 1986

[54] TERMINATION MEANS

[75] Inventor: Roger C. Stephenson, Woodland Hills, Calif.

[73] Assignee: Automation Industries, Inc., Greenwich, Conn.

[21] Appl. No.: 680,920

[22] Filed: Dec. 12, 1984

[51] Int. Cl.[4] ..... H01R 13/46

[52] U.S. Cl. ..... 339/143 R; 339/177 R; 339/136 R

[58] Field of Search ..... 339/143, 147, 64 M, 339/177, 14 R, 14 P, 136 R, 136 M

[56] References Cited

U.S. PATENT DOCUMENTS

| | | | |
|---|---|---|---|
| 3,242,456 | 3/1966 | Duncan | 339/64 M |
| 3,363,220 | 1/1968 | Redd et al. | 339/64 M |
| 3,825,874 | 7/1974 | Peverill | 339/143 R |
| 4,079,343 | 3/1978 | Nijman | 339/143 R |
| 4,161,816 | 7/1979 | Frano et al. | 339/143 R |
| 4,260,966 | 4/1981 | Boutros | 339/147 R |

*Primary Examiner*—Gil Weidenfeld
*Assistant Examiner*—David L. Perlot
*Attorney, Agent, or Firm*—George J. Netter

[57] ABSTRACT

The cable shield is removed for a short distance from the end cable wire to be inserted into a contact. A generally circular plate has a flange permitting receipt within the connector part shell and a circumferential spring for insuring continuous electrical contact. A plurality of openings are formed in the plate which align with the individual openings in the connector insert. Each plate opening includes a hollow cylindrical metal tube affixed therein with an internal bore enabling receipt of a cable wire with shield and cladding. A leaf spring contact electrode is secured to the wire shield spaced from the cable wire end and lies within the hollow tube, the prepared end of the wire passing out the other end of the tube for receipt within a contact. The plate with tubes is then fitted within the connector part shell providing termination.

3 Claims, 12 Drawing Figures

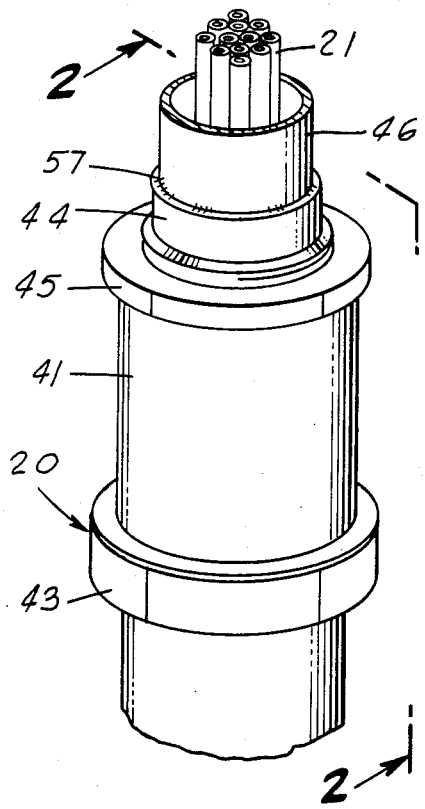
FIG. 1
FIG. 2
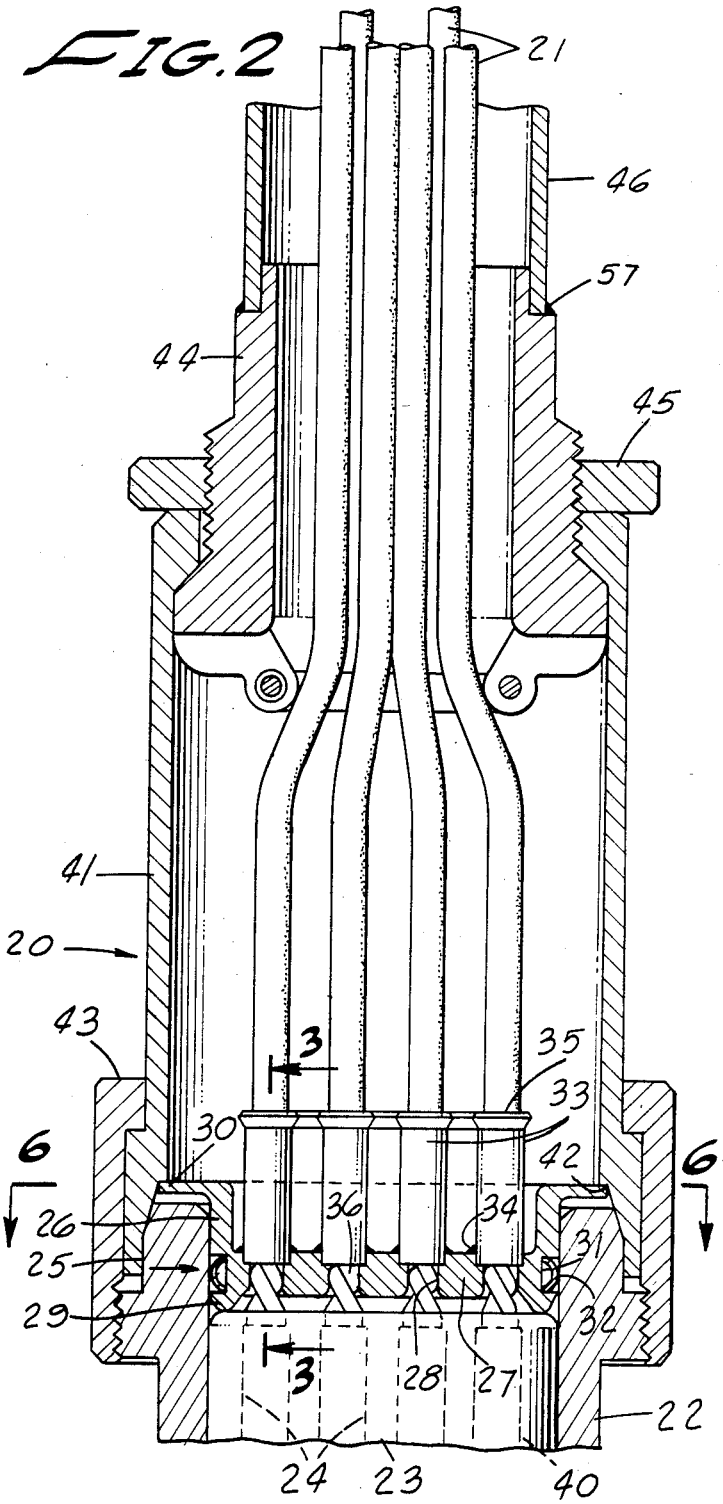
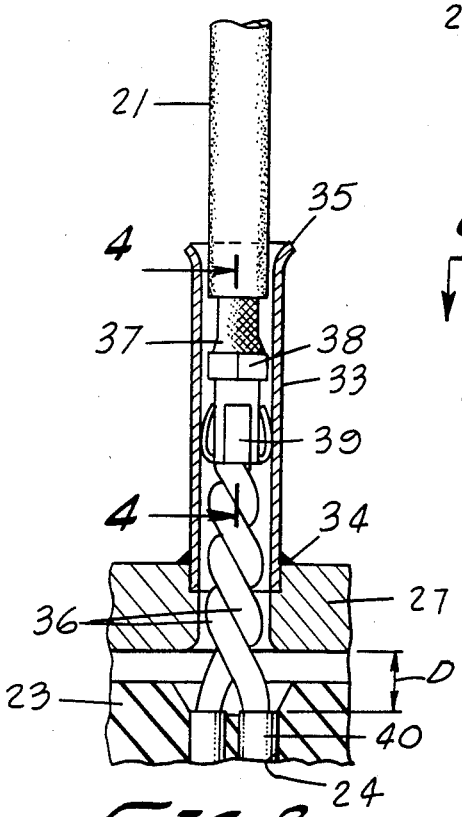
FIG. 3
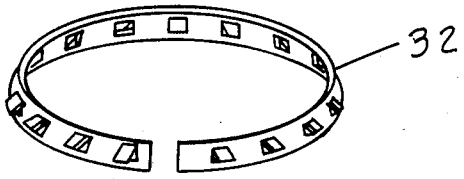
FIG. 7

TERMINATION MEANS

The present invention relates generally to a means for terminating both overall and individual cable wire shields of a multi-wire cable to a grounding member.

BACKGROUND OF THE INVENTION

There are many instances where it is desirable or necessary to ground or terminate cable wire shields, such as, for example, in electrical connectors, junction boxes, or electronic equipment, to name a few. For ease of presentation the invention will be particularly described in connection with application to an electrical connector.

A highly successful present day electrical connector for one or more cable wires includes plug and receptacle connector parts releasably mateable to interconnect pin and socket contacts which are, in turn, connected to the cable wires. Present day missile and aircraft systems and bases have exceptionally high requirements for shielding attenuation necessitating grounding of each individual wire shield to an electrical connector at a point only very slightly spaced from the connector contact. Experience has shown that jumpers for grounding of shielding in connectors produce relatively high impedance when subjected to nuclear event EMP current level pulses and are therefore unsatisfactory. Along with the use of any shielding technique or device, it is desirable to be able to maintain repairability of the connector cable assembly both to insure adequate logistic support as well as for economic reasons. All past known techniques for attenuating cable wire shields at a connector are relatively complex, have high electrical impedance, and are expensive to manufacture or not easily repairable.

SUMMARY OF THE INVENTION

A connector part with which the termination means to be described is especially effective has a hollow metal shell housing within which are insulative insert is received. A plurality of openings extend exially through the insert within which connector contacts, (e.g., pins or sockets) are located and to which cable wires are affixed either by crimping or soldering, for example. Each cable wire, whether containing one or several conductors, has a separate shield such as a metallic braid, for example, which encloses the cable wire and prevents the induction of interfering signals into the cable wire conductor/s by external electromagnetic fields.

In accordance with the termination technique and means to be described, the cable shield is removed for a short distance from the end of the cable wire that has been prepared for insertion into a contact. A generally circular shielding means has a continuous flanged edged wall of dimension permitting receipt within the connector part shell and a circumferential spring for insuring continuous electrical contact between the shielding means and the connector shell. A plurality of openings are formed in the shielding means which can be aligned with the individual openings in the connector insert containing the contacts. Each of the shielding means openings includes a hollow cylindrical metal tube affixed therein with an internal bore enabling receipt of a cable wire with shield and outer cladding therethrough. A leaf spring contact electrode is secured to the cable wire shield spaced from the cable wire end and lies within the hollow tube, the prepared end of the cable wire passing out the other end of the tube for receipt within a pin or socket contact, as the case may be. The shielding means with tubes mounted therein is then fitted within the connector part shell which provides an interconnection between the cable shield and the connector shell at a point closely located with respect to the contact to which the cable is interconnector (e.g., within 1 centimeter).

DESCRIPTION OF THE DRAWING

FIG. 1 is a perspective view of a connector part shown fully assembled with cable wires extending from an end thereof.

FIG. 2 is a side elevational, sectional view of the connector part of FIG. 1 taken along the line 2—2 of FIG. 1.

FIG. 3 is a side elevational sectional view taken along the line 3—3 of FIG. 2.

FIG. 7 is a perspective view of a spring for aiding interconnection of the termination plate to the connector shell.

DESCRIPTION OF PREFERRED EMBODIMENTS

Figure 4:
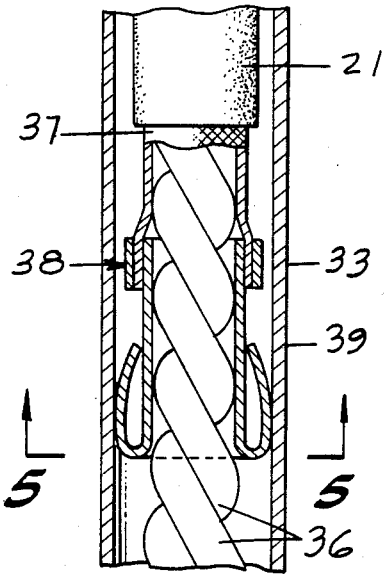
FIG. 4 is a side elevational, slightly enlarged, partially fragmentary view taken along the line 4—4 of FIG. 3.

Turning now to the drawings and particularly FIG. 1 thereof, the connector part 20 may typically be either the receptacle or plug of a well-known electrical connector having plug and receptacle parts which can be releasably joined together to effect interconnection between sets of cable wires, such as those enumerated as at 21 or the termination of a cable into a junction box or other electrical component. Since the details of the operation and construction of such a connector are not generally pertinent to the invention to be described herein, reference is made to U.S. Pat. No. 4,066,315 if a more detailed presentation or such a connector is desired.

Turning now additionally to FIG. 2, the connector part 20 for purposes of illustration of the application of the present invention is seen to include a hollow, generally cylindrical metal shell 22 within which is fitted an insulative insert 23. A plurality of openings extend through the insert 23 for receiving contacts (e.g., pin or socket) which interconnect with complementary contacts in another connector part to establish the desired electrical interconnection. In the usual connector, cable wires 21 are fed into the respective openings 24 in the insert where they are either crimped or soldered to a pin or socket contact, as the case may be.

Still referring to FIG. 2, a termination or shielding means 25 includes a generally cylindrical sidewall 26 of such dimensions as to enable sliding fit within the connector part shell 22. A generally circular plate 27 unitarily related to the sidewall 26 includes a plurality of openings 28 which align with the openings 24 in the insert 23 when the shielding means is located within the end of the shell 22. A continuous raised ridge 29 faces toward the insert 23 and serves to space the shielding means plate 27 from the outer end of the insert. A radially outwardly extending flange 30 lies at the innermost end of the connector part shell 20 and will be used for a purpose to be described later herein.

A circumferentially extending groove 31 in the peripheral surface of the shielding means 25 includes a leaf-spring ring 32 which by virtue of its inherent spring-like qualities not only aids in retention of the shielding means within the shell 22 but also establishes and enhances electrical contact between the two.

Extending outwardly away from the shielding means 25 in each of the openings 28 is a hollow cylindrical metal tube 33. More particularly, each openings 28 is slightly enlarged on the side facing the incoming cable wires in order to receive an end portion of a tube 33 therein which is affixed both physically and electrically therein by a circumferentially extending weldment 34. The outer end of each of the tubes is flared slightly as at 35 to facilitate receiving a cable wire 21 (FIG. 3).

As can be seen best in FIG. 3, each cable wire 21 includes one or more individual insulated wires 36 located within a shield 37 (e.g., metal braid), which, in turn, may be enclosed within an insulative outer cladding. Dimensionally, each individual cable wire 21 is readily received within the bore of a tube 33.

Figure 5:
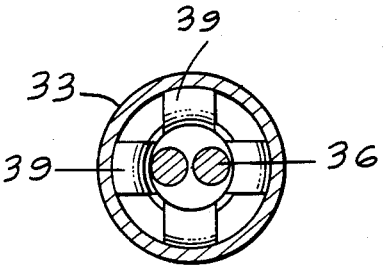
FIG. 5 is an end elevational, sectional view taken along the line 5—5 of FIG. 4.
Figure 8:
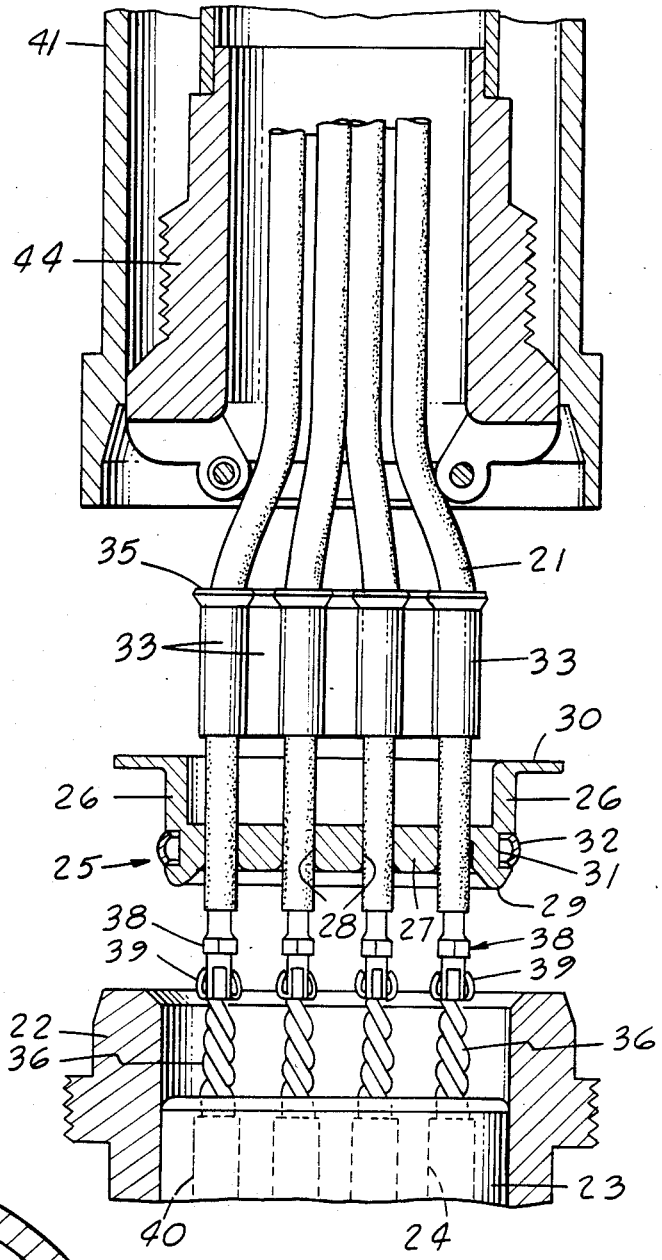
FIG. 8 is a side elevational view similar to FIG. 2 showing the termination plate in raised nonoperative condition with respect to the cable ends.
Figure 6:
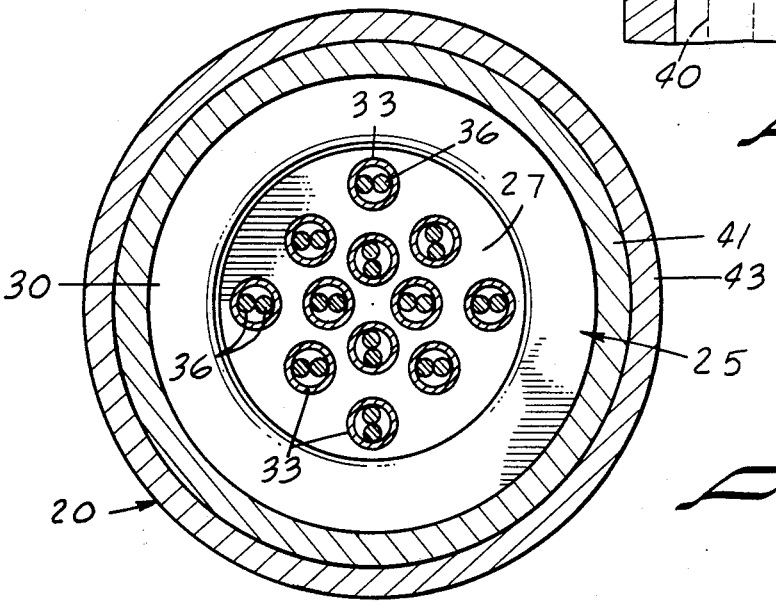
FIG. 6 is an end elevational, sectional view taken along the line 6—6 of FIG. 2.

In preparation for effecting terminating of the cable shield 37 by the described apparatus, the outer insulation and cable shield is removed from the cable end exposing a length of the individual wires 36 as shown in FIG. 3. A contact electrode 38 includes a crimp ring mechanically and electrically which fixes the shield 37 to a cylindrical metal portion that extends about the cable wires 36, the terminus of the latter including a plurality of leaf-spring members 39 that are folded back onto the cylindrical portion (FIG. 5). With the contact electrode 38 affixed to the shield 37 and the cable fittingly received within the tube 33, the spring-like ends 39 continuously and resiliently contact the inner surface of the metal tube thereby providing a continuous electrical contacting relationship between the cable shield and the tube 33 which by virtue of its interconnection with the shielding means 25 effects continuous contact with the connector part shell 22.

It is clear from FIGS. 2 and 3 that the cable wires 36 are continuously shielded throughout except for the space D which extends from the inwardly facing surface of the plate 27 to the end of the socket or pin contact enumerated generally as at 40. Although the distance D will vary somewhat depending on connector size, it is contemplated that it can be maintained to not more than about 1 centimeter.

Still referring to FIG. 2, with the shielding means 25 received within the shell 22 and the cable wires 36 suitably retained within pin or socket contacts 40, a cylindrical backshell 41 is fitted onto the end of the connector part shell 22 and has an internal shoulder 42 which securely engages the shielding means flange 30. A coupling housing 43 threads onto the connector part shell 22 thereby holding the backshell firmly thereto. The backshell may be enclosed at its outer end by a threaded fitting 44 secured to the fitting by a weldment 46, for example, surrounds the full set of cable wires 21 and is grounded via the backshell to the connector shell 22.

For the ensuing description of an alternate embodiment of the termination and shielding means reference is made to FIGS. 9–12. The connector part, backshell and means for mounting the backshell to the connector part are identical to those of the first-described embodiment and that enumeration will be followed herein. As shown there, and particularly in FIG. 12, the termination and shielding means includes a one-piece, metal , generally cup-shaped member 47 having a bandlike sidewall 48, a flange 49 and a circular bottom wall 50. A plurality of openings 51 in the bottom wall 50 are so arranged as to be alignable with insert openings 24 when the cup-shaped member is located within the connector part shell 22.

A stub cylinder 52 extends upwardly from each openings 51 at ninety degrees from the bottom wall 50. These cylinders may either be formed unitarily from the bottom wall material, or separately and welded to the bottom wall. In either case, the outer diameter of the stub cylinders is such as to accept hollow metal tubes 53 thereon and which may be identical to cylinders 33 of the first-described embodiment. Securement of the tubes 53 to the stub cylinders 51 may be by weldments 54, for example.

Figure 9:
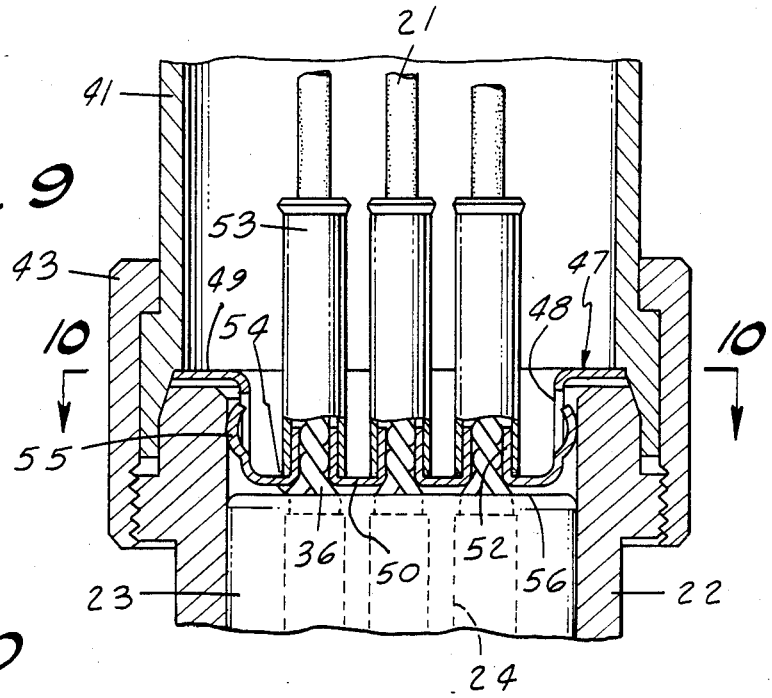
FIG. 9 is a side elevational sectional view of an alernative construction of the invention.
Figure 10:
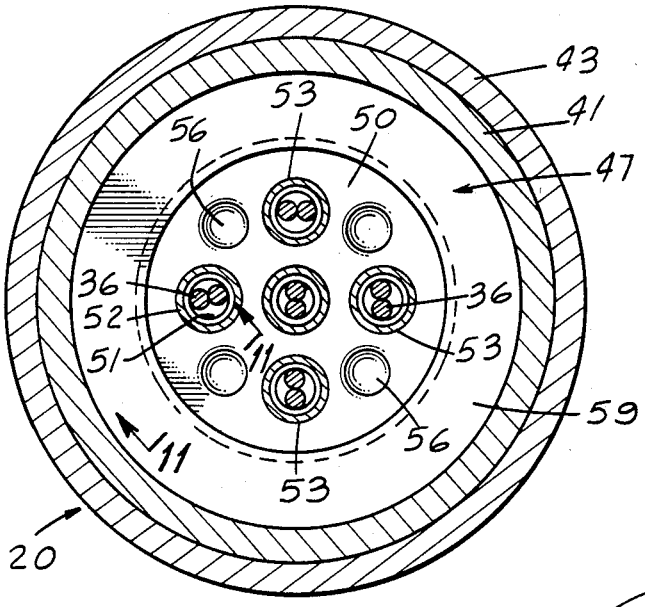
FIG. 10 is an end elevational, sectional view taken along the line 10—10 of FIG. 9.
Figure 12:
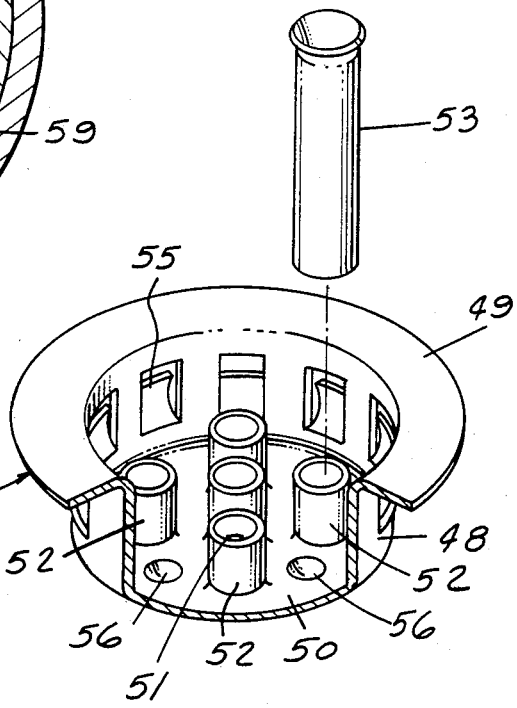
FIG. 12 is a perspective, partially fragmentary exploded view of the embodiment of FIG. 9.
Figure 11:
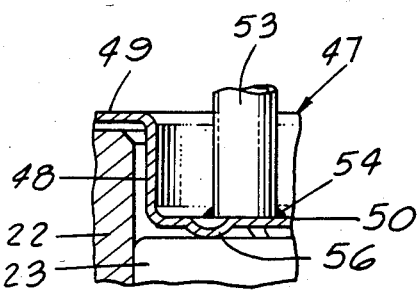
FIG. 11 is a sectional view taken along the line 11—11 of FIG. 10.

The sidewall 48 has a plurality of cut-out portions 55 arranged about the periphery which act as leaf springs when the cup-shaped member is located within the shell 22 (FIG. 9). The function and securement by the backshell are the same in the first embodiment. Finite spacing of the plate 50 from the insulative insert is provided formed projections 56 in the plate material (FIG. 11).

In accordance with the practice of this invention there are provided means for terminating a shielded cable to a ground plane where the grounding path has optimally minimal electrical impedance. The terminating means as used in an electrical connector is totally repairable in that the connector contacts may be replaced, or the entire cable replaced without breaking the termination connection. In fact, the entire cable can be removed and attached, say, to another connector without cutting or breaking any permanent joint of the termination means described herein. Still further, individual contacts 40 may be cut off the cable wires and replaced without destroying the termination means.

What is claimed is:

1. Means for effecting electrical termination of a cable wire shield to an open-ended conductive shell, comprising:

plate means for receipt within the shell open end, said plate means having an opening therein, a peripheral recess and an integral flange facing the shell open end;

means threaded onto the shell open end for securing the plate means flange against the shell end;

spring ring means located within the plate means recess for conductively interrelating the plate means to the shell spring means including a leaf spring having a curved cross-section with a convex portion thereof contacting the inner wall of the shell;

a conductive tube having a bore therethrough and an end conductively secured to the plate means by a weldment with the tube bore aligned with the opening in the plate means, the other end of the tube being flared outwardly; and leaf spring contact electrode means for being carried by the cable wire and electrically interconnecting the cable wire shield to the inner wall of the conductive tube.

2. Means for effecting electrical termination as in claim 1, in which a plurality of openings are formed in the plate means and a corresponding plurality of conductive tubes are respectively secured to the plate means in alignment with the openings.

3. Means for effecting electrical termination of a cable wire shield to an open-ended conductive shell comprising:

plate means with bandlike sidewalls for receipt within the shell open end, said plate means having an opening therein and an integral flange facing the shell open end;

said bandlike sidewalls including a plurality of cutout portions forming spring means for resiliently engaging an inner surface of the shell;

hollow stub cylinder means integrally related to the plate means and aligned with the opening therein;

a conductive tube having a bore therethrough and one end thereof being telescopingly received on said stub cylinder means with the tube end portion being welded to the plate means; and leaf spring contact electrode means for electrically interconnecting the cable wire shield to the inner surface of the conductive tube.

* * * * *